US010010162B1

(12) United States Patent
Woods et al.

(10) Patent No.: US 10,010,162 B1
(45) Date of Patent: Jul. 3, 2018

(54) PORTABLE BEVERAGE SERVICE DEVICE

(71) Applicants: Danny K. Woods, Brazil, IN (US); Craig M. Bracken, Indianapolis, IN (US); Thomas Tuttle, Carmel, IN (US)

(72) Inventors: Danny K. Woods, Brazil, IN (US); Craig M. Bracken, Indianapolis, IN (US); Thomas Tuttle, Carmel, IN (US)

(73) Assignee: Bar2Go LLC, Brazil, IN (US)

( * ) Notice: Subject to any disclaimer, the term of this patent is extended or adjusted under 35 U.S.C. 154(b) by 0 days.

(21) Appl. No.: 15/458,127

(22) Filed: Mar. 14, 2017

(51) Int. Cl.

| | |
|---|---|
| ***A45F 3/46*** | (2006.01) |
| ***A47G 23/02*** | (2006.01) |
| ***A47G 23/04*** | (2006.01) |
| ***B65D 25/10*** | (2006.01) |
| ***B65D 81/38*** | (2006.01) |
| ***B65D 43/16*** | (2006.01) |

(Continued)

(52) U.S. Cl.
CPC ..... *A45F 3/46* (2013.01); *A47G 23/0241* (2013.01); *A47G 23/0266* (2013.01); *A47G 23/04* (2013.01); *B65D 25/108* (2013.01); *B65D 25/2867* (2013.01); *B65D 43/165* (2013.01); *B65D 51/242* (2013.01); *B65D 81/3816* (2013.01); *A47G 2023/0275* (2013.01); *B65D 2231/025* (2013.01); *B65D 2525/281* (2013.01); *B65D 2525/289* (2013.01); *B65D 2581/05* (2013.01)

(58) Field of Classification Search
CPC ... A45F 3/46; A47G 23/0241; A47G 23/0266; A47G 23/04; A45C 11/20; F25D 3/08; F25D 3/06; F25D 3/105; F25D 3/125; F25D 11/003; B65D 25/108; B65D 25/10; B65D 25/04; B65D 25/2867; B65D 25/28; B65D 43/165; B65D 43/161; B65D 43/16; B65D 51/242; B65D 51/24; B65D 81/3816; B65D 81/3813; B65D 81/38; B65D 1/24; B65D 1/36; B65D 1/34
USPC ..... 220/23.88, 23.87, 522, 521, 510, 509, 220/756, 760, 759, 524, 523, 526, 592.03, 220/915.2, 915.1, 556, 553, 507, 826, 220/810; 62/457.7, 457.1, 457.5, 457.4, 62/457.2; 190/111, 109
See application file for complete search history.

(56) References Cited

U.S. PATENT DOCUMENTS 2,347,270 A * 4/1944 Larsson ..... B25H 3/023 190/30
3,401,535 A * 9/1968 Palmer ..... F25D 3/00 206/139

(Continued)

*Primary Examiner* — Robert J Hicks
(74) *Attorney, Agent, or Firm* — PatentFile, LLC; Bradley C. Fach; Steven R. Kick

(57) ABSTRACT

A portable beverage service device may include a base, defining a central cavity, and a minor lid movably coupled to the base. An organizing divider may be disposed in the base over the central cavity. A plurality of container receptacles may be positioned on the organizing divider and may extend into the central cavity. A chest, which may define an auxiliary cavity that extends into the central cavity, may be disposed in the organizing divider. A major lid, having a lateral restraint, may be coupled to the base and may be movable between a major lid open position and a major lid closed position. The lateral restraint may be moved to a horizontal position when the major lid is in the major lid closed position, and the lateral restraint may be moved to a vertical position when the major lid is in the major lid open position.

19 Claims, 5 Drawing Sheets

(51) Int. Cl.
*B65D 25/28* (2006.01)
*B65D 51/24* (2006.01)

(56) References Cited

U.S. PATENT DOCUMENTS

| | | | | |
|---|---|---|---|---|
| 4,889,257 | A | 12/1989 | Steffes | |
| 6,357,252 | B1 | 3/2002 | Rand | |
| 6,364,329 | B1 | 4/2002 | Holub et al. | |
| 6,851,276 | B2 | 2/2005 | Perrins | |
| 7,334,802 | B2 | 2/2008 | Kaplan | |
| 7,766,179 | B2 | 8/2010 | George et al. | |
| 7,841,207 | B2 | 11/2010 | Mogil et al. | |
| 8,733,577 | B2 | 5/2014 | Patterson | |
| 8,899,071 | B2 | 12/2014 | Mogil et al. | |
| 9,310,118 | B2 | 4/2016 | Zavitsanos | |
| 2010/0212351 | A1 | 8/2010 | Chapin et al. | |
| 2014/0077467 | A1 * | 3/2014 | Galante | B62B 1/12 280/35 |

* cited by examiner

PORTABLE BEVERAGE SERVICE DEVICE

FIELD OF THE INVENTION

This patent specification relates to the field of devices configured to transport and service beverages. More specifically, this patent specification relates to devices configured to provide a personal, portable, and complete beverage service station.

BACKGROUND

Beverages are commonly enjoyed by people in a wide variety of activities. While alcoholic beverages are often desired, their selection tends to be limited by the venue at which the alcoholic beverages are to be consumed. For example, when traveling or at an outdoor venue, an individual may be limited to pre-made single serve beverages such as provided in bottles and cans. Mixed drinks and their appropriate garnishes have traditionally been considered unattainable or limited to a single spirit and mixer due to the difficultly in transporting, storing, and maintaining multiple spirits and mixers in a chilled and desirable condition.

While cooler devices exist and may be used to transport multiple spirits, mixers, and garnishes, they suffer many drawbacks that make them less than ideal for beverage service. While some cooler devices are large and able to accommodate multiple spirits, mixers, and garnishes, they do so in a large cavity in which the contents can tip over, be damaged, and become wet from melted ice. While other cooler devices may have individual compartments for spirits and mixers, they are limited in the number they are able to accommodate. Still other cooler devices while suitable for transport, provide no or limited accommodation for service of the beverages once they are mixed and ready to be consumed.

Therefore a need exists for a novel devices configured to transport and service beverages. There is also a need for novel beverage transport devices which are able to accommodate and organize multiple spirits, mixers, and garnishes. A further need exists, for novel beverage transport devices that provide accommodation for service of beverages once they are mixed and ready to be consumed. Finally, a need exists for novel beverage transport devices which are able to provide a full or extensive bar service station.

BRIEF SUMMARY OF THE INVENTION

A table beverage service device is provided. The device may be configured to store, transport, and present a plurality of beverage service items while organizing and maintaining the beverage service items proximate to a cooling substance such as ice.

In some embodiments, the device may include a base having two opposing sidewall panels and two opposing end panels extending between the sidewall panels. The end panels and the sidewall panels may be coupled to a bottom panel, thereby defining a central cavity which may be used to contain a volume of a cooling substance within the base. An organizing divider may be disposed in the base over the central cavity. A plurality of container receptacles may be positioned on the organizing divider and may extend into the central cavity. A chest, which may define an auxiliary cavity that extends into the central cavity, may be disposed in the organizing divider. A major lid, which may have a lateral restraint, may be coupled to a first sidewall panel and may be movable between a major lid open position and a major lid closed position. The lateral restraint may be moved to a horizontal position when the major lid is in the major lid closed position, and the lateral restraint may be moved to a vertical position when the major lid is in the major lid open position. A minor lid may be movably coupled to a second sidewall panel and may be movable between a minor lid open position and a minor lid closed position.

In further embodiments, the device may include a handle which may be coupled to the major lid and which may be movable between a carrying position and a support position. The handle may have a terminal surface, and the terminal surface may be positioned in the same plane as the bottom panel when the handle is in the support position.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
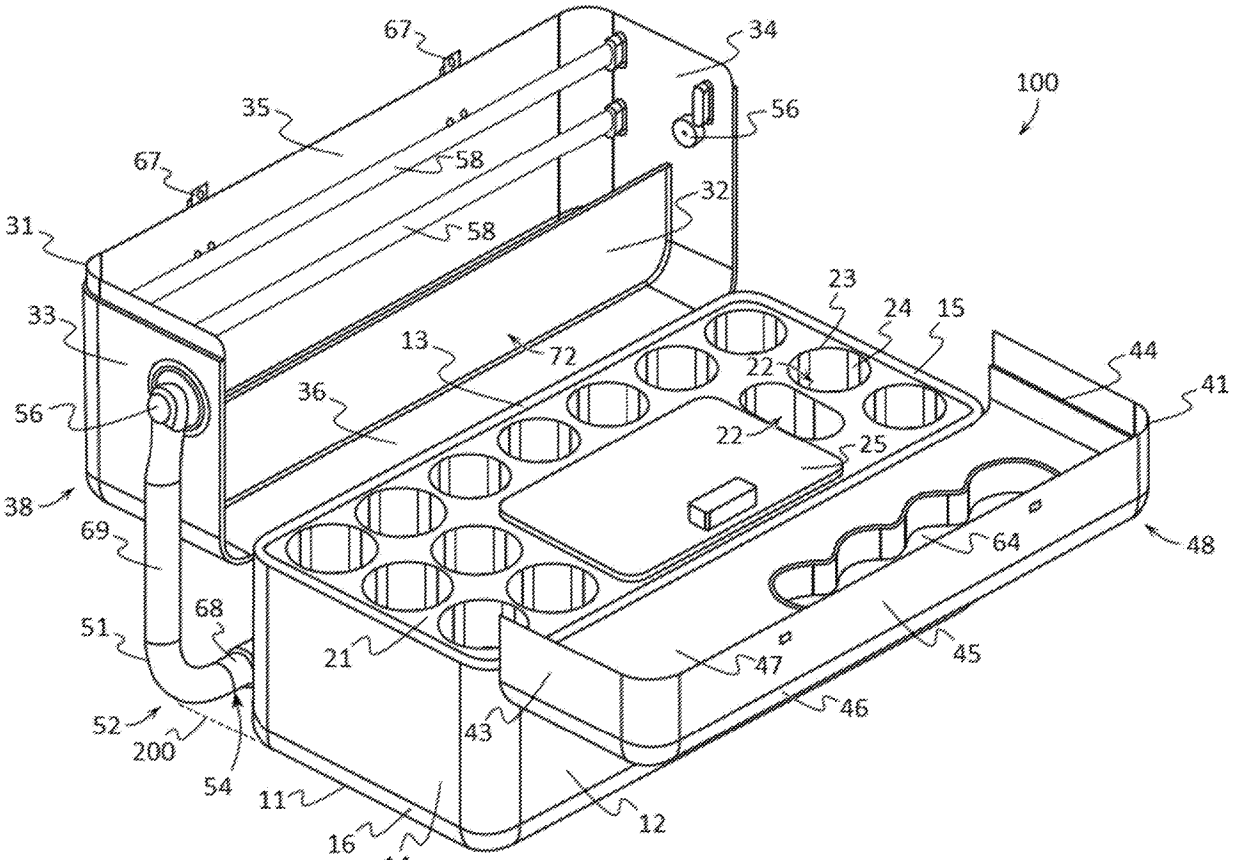
FIG. 1 depicts a first side perspective view of an example of a portable beverage service device having a major lid in an open position and a minor lid in an open position according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

New devices configured to transport and service beverages are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1-5 illustrate an example of a portable beverage service device ("the device") 100 according to various embodiments. In some embodiments, the device 100 may comprise a base 11 having two opposing sidewall panels 12, 13, and two opposing end panels 14, 15, extending between the sidewall panels 12, 13. The end panels 14, 15, and the sidewall panels 12, 13, may be coupled to a bottom panel 16, thereby defining a central cavity 17 within the base 11. An organizing divider 21 may be disposed in the base 11 over the central cavity 17. A plurality of container receptacles 22 may be positioned on the organizing divider 21 and may extend into the central cavity 17. A chest 25, which may define an auxiliary cavity 26 that extends into the central cavity 17, may be disposed in the organizing divider 21. A major lid 31, which may have a lateral restraint 32, may be coupled to a first sidewall panel 12 and may be movable between a major lid open position 38 and a major lid closed position 39. The lateral restraint 32 may be moved to a horizontal position 71 when the major lid 31 is in the major lid closed position 39, and the lateral restraint 32 may be moved to a vertical position 72 when the major lid 31 is in the major lid open position 38. A minor lid 41 may be movably coupled to a second sidewall panel 13 and may be movable between a minor lid open position 48 and a minor lid closed position 49.

In some embodiments, the base 11 may comprise a generally rectangular prism shape and define a central cavity 17 also having a generally rectangular prism shape. The end panels 14, 15, may be positioned opposite to each other and coupled generally perpendicularly to the bottom panel 16, while the sidewall panels 12, 13, may be positioned opposite to each other and coupled generally perpendicularly to the bottom panel 16 and generally perpendicularly to the end panels 14, 15. In other embodiments, a bottom panel 16 may be coupled to or integrally formed with one or more panels 12, 13, 14, 15, to form a base 11 and central cavity 17 in any other geometric shape. For example, a bottom panel 16 and/or one or more panels 12, 13, 14, 15, may be shaped to form a hemispherical base 11 and central cavity 17.

In some embodiments, the base 11 may be made of or comprise an insulating material which may prevent or reduce the temperature equilibrium between the environment that the device 100 occupies and between the items contained within the central cavity 17 and other areas of the device 100. An insulating material may comprise or be made from mineral wool, fiberglass, cellulose, polyurethane foam, polystyrene, Pyrogel, Polyisocyanurate, and natural fibers such as hemp, cellulose, cotton, or any other insulation material including combinations of materials. In still further embodiments, an insulating material may be used to form vacuum pockets which may serve insulation purposes. Optionally, the base 11 may comprise a durable material such as metal and metal alloys, plastic, natural and artificial rubber, resins, carbon fiber, and wood which may bound an insulating material.

Figure 3:
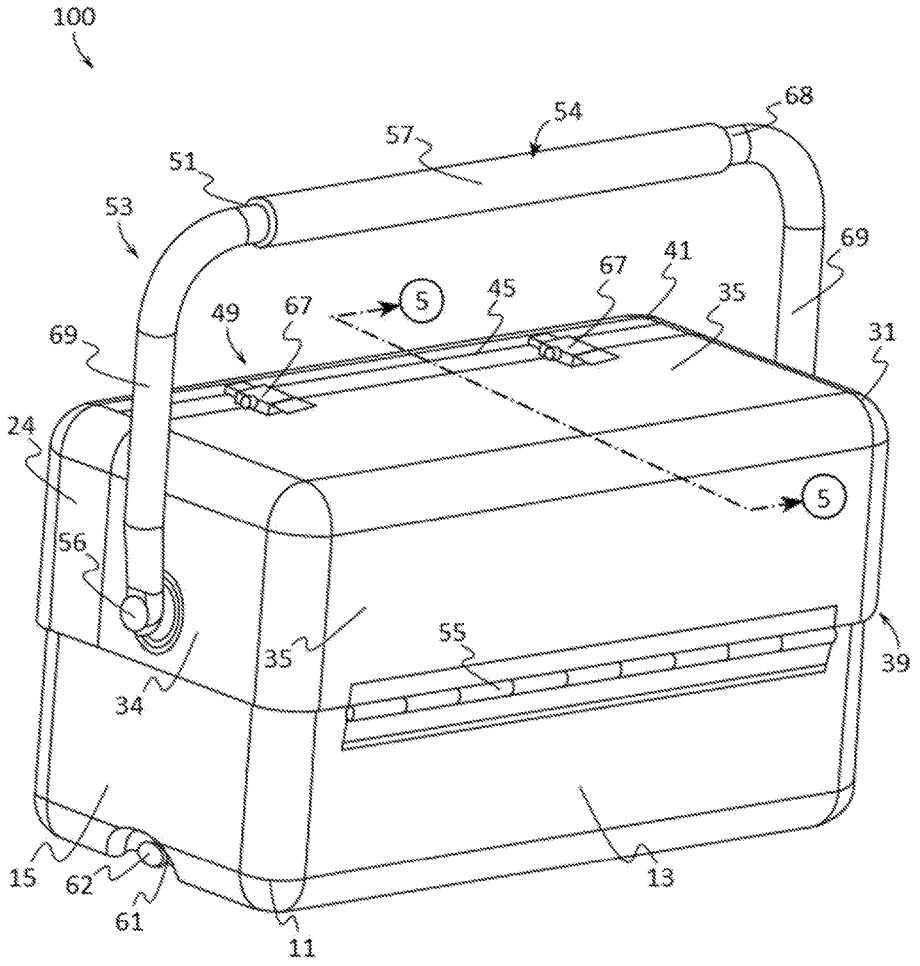
FIG. 3 shows a rear perspective view of an example of a portable beverage service device having a major lid in a closed position and a minor lid in a closed position according to various embodiments described herein.
Figure 4:
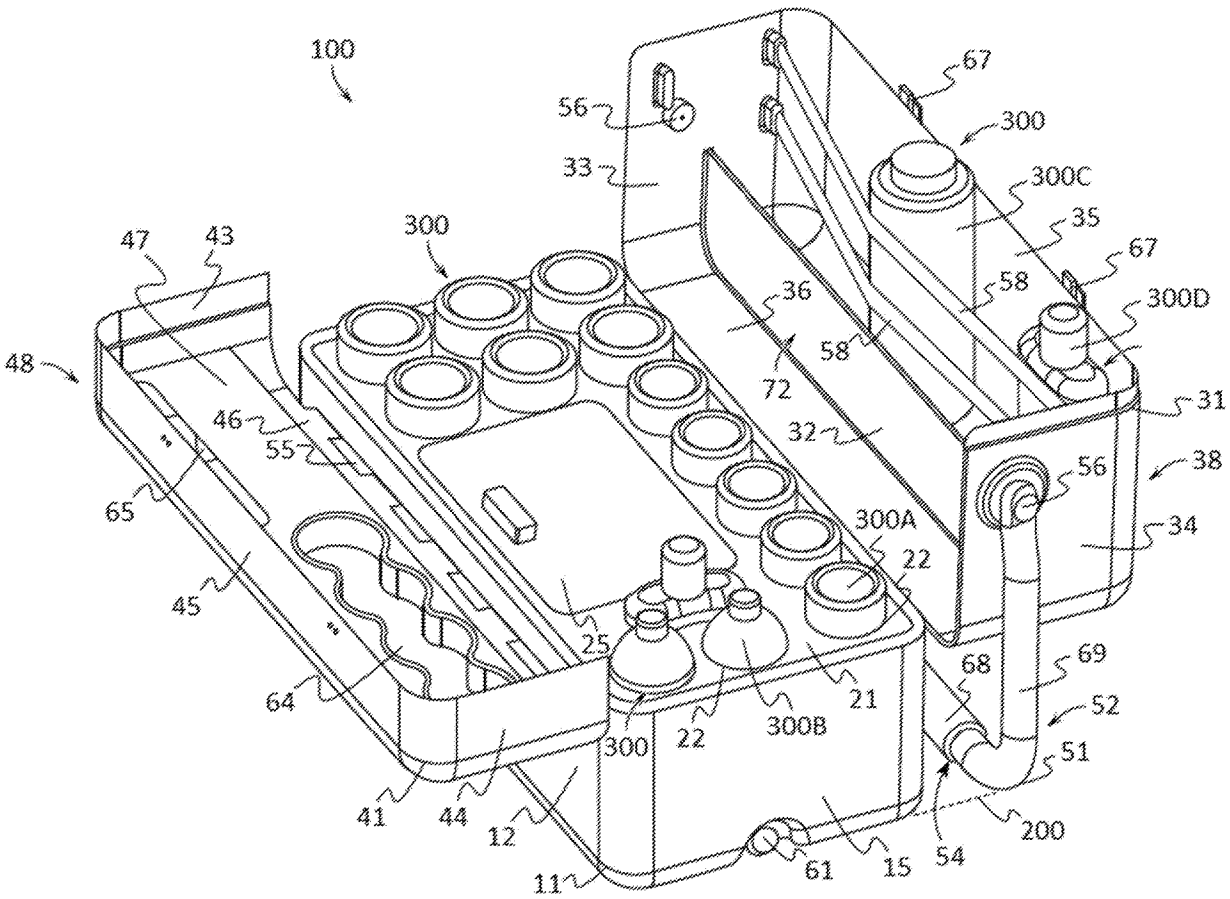
FIG. 4 depicts a second side perspective view of an example of a portable beverage service device which has received a plurality of beverage service items and which has a major lid in an open position and a minor lid in an open position according to various embodiments described herein.

Optionally, and as shown in FIGS. 3 and 4, the device 100 may comprise a drain 61 which may be in communication with the central cavity 17. A drain 61 may be positioned anywhere on the bottom panel 16 and/or on one or more panels 12, 13, 14, 15, and may provide an opening or aperture through the base 11 for water and the like, such as from melted ice within the central cavity 17, to exit the central cavity 17. The drain 61 may comprise a removable covering 62 which may govern the ability of water and the like to exit the central cavity 17.

Figure 5:
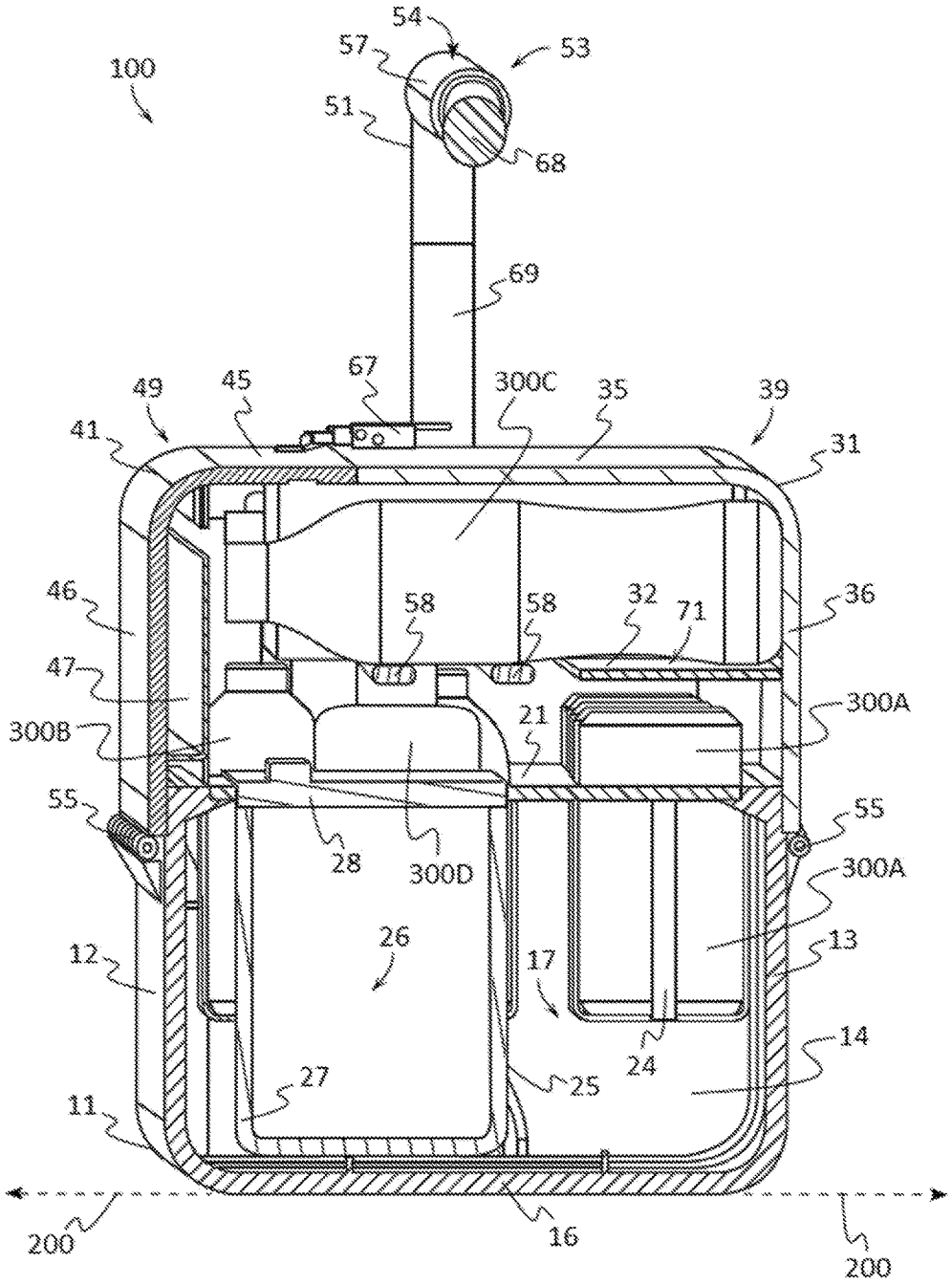
FIG. 5 illustrates a sectional, through line 5-5 shown in FIG. 3, elevation view of an example of a portable beverage service device which has received a plurality of beverage service items and which has a major lid in a closed position and a minor lid in a closed position according to various embodiments described herein according to various embodiments described herein.

Referring now to FIGS. 1, 4, and 5, an organizing divider 21 may be disposed or positioned in the base 11 over the central cavity 17. The organizing divider 21 may be complementary in shape to the shape of the central cavity 17 so that the organizing divider 21 may cover and extend over the central cavity 17 to each of the panels 12, 13, 14, 15. In some embodiments, the organizing divider 21 may be supported by one or more of the panels 12, 13, 14, 15, such as by resting on one or more protrusions which may be formed or coupled to a panel 12, 13, 14, 15, thereby allowing the organizing divider 21 to be maintained in the base 11 through the action of gravity. In other embodiments, an organizing divider 21 may be removably coupled to the base 11, such as to one or more of the panels 12, 13, 14, 15, with one or more fasteners, or any other suitable removable connection method. In alternative embodiments, an organizing divider 21 may be integrally formed or otherwise coupled to the base 11.

In some embodiments, an organizing divider 21 may comprise one, two, three, four, five, six, or more, such as a plurality, of container receptacles 22 which may be positioned on the organizing divider 21 and may extend into the central cavity 17. Each container receptacle 22 may receive one or more beverage service items 300, such as soda cans 300A, beverage bottles 300B, spirit bottles 300C, flask bottles 300D, or any other type of container or object.

In preferred embodiments, a container receptacle 22 may comprise a container aperture 23 in the organizing divider 21 to which a container support 24 may be coupled to. In other embodiments, a container support 24 may be coupled to any element of the base 11. A container support 24 may limit the position or depth to which a beverage service item 300 may be inserted into the container aperture 23 of the container receptacle 22. In some embodiments, a container support 24 may be generally U-shaped, while in other embodiments, a container support 24 may comprise or be configured in any other shape. In further preferred embodiments, a container receptacle 22 may be configured for receiving a cylindrical beverage service item, such as a soda can 300A or beverage bottle 300B, by comprising a circular shaped container aperture 23. In other embodiments, a container aperture 24 may comprise a stadium shape, which may be used to accommodate flask bottles 300D or the like having a stadium shaped cross section, a triangular shape, a rectangular shape, or any other shape.

In preferred embodiments, one or more of the container receptacles 22 may be in communication with the central cavity 17 so that air, water, and other substances may pass between the central cavity 17 and the container aperture 23 of a container receptacle 22. For example, a container receptacle 22 comprising a U-shaped container support 24 may allow air, water, and other substances to pass on either side of the container support 24. In further embodiments, a container receptacle may comprise a container support 24 substantially complementary in shape to a beverage service item 300 and having one or more holes or other openings which may enable the container receptacle 22 to be in communication with the central cavity 17. In alternative embodiments, a container receptacle 22 may not be in communication with the central cavity 17 so that air, water, and other substances may not pass between the central cavity 17 and the container aperture 23 of a container receptacle 22. For example, a container support 24 may be substantially complementary in shape to a beverage service item 300 and the container support 24 may seal the container receptacles 22 from the central cavity 17.

In some embodiments, the device 100 may comprise a chest 25 which may be disposed in the organizing divider 21. The chest 25 may comprise one or more chest walls 27 which may define an auxiliary cavity 26 that extends into the central cavity 17. Similar to the central cavity 17, the chest 25 may be used to contain a volume of ice, however the chest 25 may be used to segregate the ice in the auxiliary cavity 26 from the central cavity 17 with the one or more chest walls 27. Optionally, the auxiliary cavity 26 may be in communication with the central cavity 17 to allow water to drain from the auxiliary cavity 26 into the central cavity 17.

In preferred embodiments, the chest 25 may comprise a cover 28, as shown in FIG. 5, which may control access to the auxiliary cavity 26. Optionally, the chest 25 may be removable from the organizing divider 21 to enable and/or to control access to the central cavity 17.

Turning now to FIGS. 1-5, the device 100 may comprise a major lid 31 and a minor lid 41 which may each be coupled to the base 11 and preferably to opposing panels 12, 13, 14, 15. In some embodiments, a major lid 31 may be coupled to a first sidewall panel 12 and movable between a major lid open position 38 and a major lid closed position 39, and a minor lid 41 may be movably coupled to a second sidewall panel 13 and may be movable between a minor lid open position 48 and a minor lid closed position 49. In preferred embodiments, the major lid 31 and minor lid 41 may each be movably coupled to the base 11 with a hinged coupling 55 that may comprise a piano hinge. In other embodiments, a hinged coupling 55 may comprise a butt hinge, barrel hinge, butt/Mortise hinge, case hinge, flag hinge, strap hinge, H hinge, HL hinge, butterfly hinge, flush hinge, barrel hinge, concealed hinge, continuous hinge, T-hinge, strap hinge, double-acting hinge, Soss hinge, counterflap hinge, flush hinge, coach hinge, rising butt hinge, double action spring hinge, tee hinge, friction hinge, security hinge, cranked hinge or stormproof hinge, lift-off hinge, self closing or self positioning hinge, flexible material hinge, living hinge, or any other type or style of hinge which may enable a lid 31, 41, to move relative to the base 11.

In some embodiments, the major lid 31 may comprise two opposing major end walls 33, 34, a major top wall 35, and a major base wall 36. The major base wall 36 may be coupled to the base 11 via a hinged coupling 55. The major end walls 33, 34, may be coupled to opposing sides of the major base wall 36, and the major top wall 35 may be coupled to the major end walls 33, 34, and also to the major base wall 36 opposite the hinged coupling 55.

In some embodiments, the major lid 31 may comprise a lateral restraint 32 which may be coupled to one or more major walls, 33, 34, 35, 36, such as to both major end walls 33, 34, and which may maintain the positioning of a beverage service item 300 proximate to the major top wall 35. The lateral restraint 32 may be coupled to the major lid 31 so that the lateral restraint 32 is moved to a horizontal position 71 (FIG. 5) when the major lid 31 is in the major lid closed position 39 (FIGS. 2, 3, and 5) and moved to a vertical position 72 (FIGS. 1 and 4) when the major lid 31 is in the major lid open position 38 (FIGS. 1 and 4). In this manner, the major lid 31 may be configured to support beverage service items 300 when in the major lid open position 38 and major lid closed position 39, by the lateral restraint 32 supporting the weight of a beverage service item 300 in the major lid closed position 39 as shown in FIG. 5, and the major base wall 36 supporting the weight of a beverage service item 300 in the major lid open position 38 as shown in FIG. 4.

Preferably, the lateral restraint 32 may be coupled to the major end walls 33, 34, so that the lateral restraint 32 is parallel to the major top wall 35. In further embodiments, the lateral restraint 32 may be planar in shape and coupled to the major end walls 33, 34, so that the lateral restraint 32 is perpendicular to the major base wall 36. While a generally planar shaped lateral restraint 32 is shown in FIGS. 3 and 4, in other embodiments, a lateral restraint 32 may be tubular or cylindrical in shape, such as a bar of material, an elongate strap of material, or any other configuration which may be suitable for maintaining the positioning of a beverage service item 300 proximate to the major top wall 35.

Optionally, the device 100 may comprise a flexible retainer 58 which may be coupled to an element of the device 100 and which may be placed in contact with one or more beverage service items 300 to maintain the positioning of the beverage service items 300 within the device 100. In preferred embodiments, the major lid 31 may comprise a flexible retainer 58, optionally coupled to one or both major end walls 33, 34, which may be generally positioned above the lateral restraint 32 thereby allowing the flexible retainer 58 to contact upper portions of a beverage service item 300 within the major lid 31 to maintain the positioning of the beverage service item 300 within the major lid 31. In some embodiments, a flexible retainer 58 may comprise a resilient or elastic band, strap, or the like, which may be stretched across portions of a beverage service item 300 within the major lid 31. In other embodiments, a flexible retainer 58 may comprise a length of fabric material, leather, chain, ribbon, or any other flexible material which may be placed across portions of a beverage service item 300 within the major lid 31.

In some embodiments, the minor lid 41 may comprise two opposing minor end walls 43, 44, a minor top wall 45, and a minor base wall 46. The minor base wall 46 may be coupled to the base 11 via a hinged coupling 55. The minor end walls 43, 44, may be coupled to opposing sides of the minor base wall 46, and the minor top wall 45 may be coupled to the minor end walls 43, 44, and also to the minor base wall 46 opposite the hinged coupling 55.

In some embodiments, the minor lid 41 may comprise a service plate 47 which may be coupled to one or more minor walls, 43, 44, 45, 46, such as to both minor end walls 43, 44, and the minor base wall 46 and which may maintain the positioning of a beverage service items 300 placed on or in the minor lid 41. Optionally, the service plate 47 may comprise one or more beverage container depressions 64 and/or one or more slots 65. A beverage container depression 64 may comprise a depression into which portions of a drinking glass, other beverage container or beverage service item 300 may be inserted or placed when the minor lid 41 is in the minor lid open position 48. In this manner, a beverage container depression 64 may be adapted to support at least one beverage container, such as a glass or soda can 300A, when the minor lid 41 is in the minor lid open position 48. A slot 65 may comprise an opening or recess which may be used to access a compartment formed between the service plate 47 and one or more minor walls 43, 44, 45, 46. The slot 65 may be used to store and access items such as beverage napkins, wet wipes, and the like.

In some embodiments, the device 100 may comprise one or more closure fasteners 67 which may removably couple the major lid 31 and minor lid 41 together. In further embodiments, the device 100 may comprise one or more closure fasteners 67 which may removably couple the major lid 31 and/or minor lid 41 to the base 11. A closure fastener 67 may comprise a clasp-type fastener, a clip-type fastener, a magnetic fastener, hook and loop type or Velcro® fastener, a push-to-lock type connection method, a turn-to-lock type connection method, slide-to-lock type connection method or any other suitable temporary connection method which may be used to removably couple a major lid 31 and minor lid 41 together or to couple a major lid 31 and/or minor lid 41 to the base 11.

Figure 2:
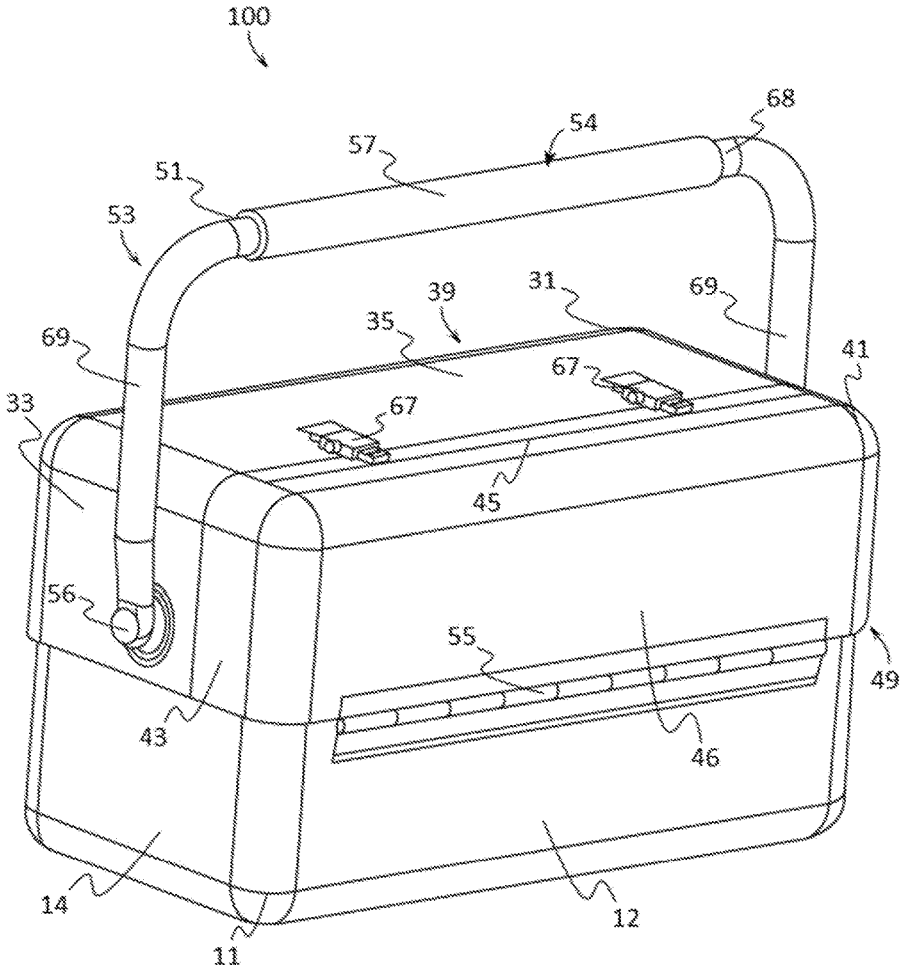
FIG. 2 illustrates a front perspective view of an example of a portable beverage service device having a major lid in a closed position and a minor lid in a closed position according to various embodiments described herein.

In some embodiments, the device 100 may comprise one or more handles 51 which may be grasped by a user and used to maneuver or transport the device 100. A handle 51 may be coupled to the base 11, major lid 31, and/or minor lid 41. In preferred embodiments, a handle 51 may be coupled to the major lid 31 and movable between a support position 52 (FIGS. 3 and 4) and a carrying position 53 (FIGS. 1, 2, and 5). In some embodiments, a handle 51 may be pivotally coupled to the major lid 31 with a pivotal coupling 56, such as with a disc coupling, ball bearing coupling, pin coupling, or other suitable method, which may enable the handle 51 to be pivoted between the support position 52 and the carrying position 53. A handle 51 may comprise one or more terminal surfaces 54 which may form a portion or a surface of the handle 51 that is farthest from the pivotal coupling 56 or element to which a handle 51 may be coupled. In preferred embodiments, when the handle 51 is in the support position 52, the terminal surface 54 may be positioned in the same level plane 200 (FIGS. 1, 4, and 5) as the bottom panel 16, thereby allowing the terminal surface 54 to rest on the same level surface that the bottom panel 16 may be resting on. In this manner, when the major lid 31 is in the major lid open position 38 and the handle 51 is in the support position 52, the handle 51 may support all or some of the weight of the major lid 31.

In some embodiments, a handle 51 may comprise a cushion 57, as perhaps best shown in FIGS. 2, 3, and 5, onto which a terminal surface 54 may be formed and which may be made of or comprise a resilient or cushioning material, such as rubber, foam, fabric, or the like, and which may be suitable for being grasped by a user and also for contacting a surface upon which the base 11 is placed. In further embodiments, a handle may comprise a lateral element 68 which may be coupled to one or more pivotal elements 69. A lateral element 68 and/or a pivotal element 69 preferably may be made from or comprise a rigid material, such as plastic, wood, metal and metal alloys, thereby allowing a lateral element 68 and pivotal element(s) 69 to support the weight of the major lid 31 and its contents when the major lid 31 is in the major lid open position 38 and the handle 51 is in the support position 52, and to support the weight of the device 100 and its contents when the handle is in the carrying position 53, with a lateral element 68 over and above the base 11 and lids 31, 41.

While some materials have been provided, in other embodiments, the elements that comprise the device 100 such as the base 11, major lid 31, minor lid 41, optional organizing divider 21, optional chest 25, and/or any other element discussed herein may be made from or comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A portable beverage service device, the device comprising:

a base having two opposing sidewall panels and two opposing end panels extending between the sidewall panels, each of the end panels and the sidewall panels are coupled to a bottom panel, thereby defining a central cavity;

an organizing divider disposed in the base over the central cavity;

a plurality of container receptacles positioned on the organizing divider and extending into the central cavity;

a major lid coupled to a first sidewall panel and movable between a major lid open position and a major lid closed position, wherein the major lid comprises a lateral restraint, and wherein the lateral restraint is moved to a horizontal position when the major lid is in the major lid closed position and the lateral restraint is moved to a vertical position when the major lid is in the major lid open position; and a minor lid movably coupled to a second sidewall panel and movable between a minor lid open position and a minor lid closed position.

2. The device of claim 1, wherein the major lid comprises two opposing major end walls, and wherein the lateral restraint is coupled to both of the major end walls.

3. The device of claim 1, further comprising a handle coupled to the major lid and movable between a carrying position and a support position, wherein the handle comprises a terminal surface, and wherein the terminal surface is positioned in the same plane as the bottom panel when the handle is in the support position.

4. The device of claim 3, wherein the handle is pivotally coupled to the major lid.

5. The device of claim 1, wherein a container receptacle is in thermal communication with the central cavity.

6. The device of claim 1, further comprising a chest disposed in the organizing divider, the chest defining an auxiliary cavity that extends into the central cavity.

7. The device of claim 1, wherein a container receptacle is configured for receiving a cylindrical beverage container.

8. The device of claim 1, further comprising a closure fastener for removably coupling the major lid and minor lid together.

9. The device of claim 1, further comprising a drain in communication with the central cavity.

10. The device of claim 1, wherein the minor lid comprises a beverage container depression adapted to support at least one beverage container when the minor lid is in the minor lid open position.

11. A portable beverage service device, the device comprising:

a base having two opposing sidewall panels and two opposing end panels extending between the sidewall panels, each of the end panels and the sidewall panels are coupled to a bottom panel, thereby defining a central cavity;

an organizing divider disposed in the base over the central cavity;

a plurality of container receptacles positioned on the organizing divider and extending into the central cavity;

a chest disposed in the organizing divider, the chest defining an auxiliary cavity that extends into the central cavity;

a major lid coupled to a first sidewall panel and movable between a major lid open position and a major lid closed position, wherein the major lid comprises a lateral restraint, and wherein the lateral restraint is moved to a horizontal position when the major lid is in the major lid closed position and the lateral restraint is moved to a vertical position when the major lid is in the major lid open position;

a handle coupled to the major lid and movable between a carrying position and a support position, wherein the handle comprises a terminal surface, and wherein the terminal surface is positioned in the same plane as the bottom panel when the handle is in the support position; and a minor lid movably coupled to a second sidewall panel and movable between a minor lid open position and a minor lid closed position.

12. The device of claim 11, wherein the major lid comprises two opposing major end walls, and wherein the lateral restraint is coupled to both of the major end walls.

13. The device of claim 11, wherein the major lid comprises a flexible retainer.

14. The device of claim 13, wherein the handle is pivotally coupled to the major lid.

15. The device of claim 11, wherein a container receptacle is in communication with the central cavity.

16. The device of claim 11, wherein a container receptacle is configured for receiving a cylindrical beverage container.

17. The device of claim 11, further comprising a closure fastener for removably coupling the major lid and minor lid together.

18. The device of claim 11, further comprising a drain in communication with the central cavity.

19. The device of claim 11, wherein the minor lid comprises a beverage container depression adapted to support at least one beverage container when the minor lid is in the minor lid open position.

* * * * *